United States Patent [19]

Stewart

[11] Patent Number: 4,718,503

[45] Date of Patent: Jan. 12, 1988

[54] METHOD OF DRILLING A BOREHOLE

[75] Inventor: Robert B. Stewart, Rijswijk, Netherlands

[73] Assignee: Shell Oil Company, Houston, Tex.

[21] Appl. No.: 901,119

[22] Filed: Aug. 28, 1986

[30] Foreign Application Priority Data

Dec. 23, 1985 [GB] United Kingdom ..... 8531627

[51] Int. Cl.[4] ..... E21B 21/12

[52] U.S. Cl. ..... 175/70; 175/215

[58] Field of Search ..... 175/70, 65, 215

[56] References Cited

U.S. PATENT DOCUMENTS

| | | | |
|---|---|---|---|
| 1,585,969 | 5/1926 | Ferguson | 175/70 |
| 2,283,510 | 5/1942 | Potter | 175/70 |
| 2,657,016 | 10/1953 | Grable | 175/215 |
| 2,716,018 | 8/1955 | Williams | 175/70 X |
| 3,102,600 | 9/1963 | Jackson | 175/215 X |
| 3,416,617 | 12/1968 | Elenburg | 175/339 |
| 3,416,618 | 12/1968 | Kunnemann | 175/215 X |
| 3,419,092 | 12/1968 | Elenburg | 175/69 |
| 3,534,822 | 10/1970 | Campbell | 175/69 |
| 3,596,720 | 8/1971 | Elenburg | 175/215 X |
| 3,664,415 | 5/1972 | Carey | 175/215 X |
| 4,171,187 | 10/1979 | Reed | 417/170 |

*Primary Examiner*—Stephen J. Novosad

[57] ABSTRACT

A method of drilling a borehole is provided using a drill bit coupled to the lower end of a pair of concentric drill pipes. During drilling a first low viscosity fluid, such as oil or water, is circulated through the pipes while a second fluid, such as a weighted viscosified mud, is kept stationary in the pipe/formation annulus.

14 Claims, 3 Drawing Figures

METHOD OF DRILLING A BOREHOLE

BACKGROUND OF THE INVENTION

The invention relates to a method of drilling a borehole into subsurface earth formations using a rotary drill bit.

In conventional drilling operations the drill bit is usually coupled to the lower end of a single-bore drill string. During drilling a drilling mud is circulated down through the drill string and up through the pipe/formation annulus between the pipe string and the borehole wall. The circulated drilling mud has three basic functions: to cool the bit, to carry cuttings to the surface and to keep the wellbore under control.

A drilling mud with sufficient viscosity, fluid-loss control and density to fulfill these functions is inherently a poor fluid for achieving a high penetrations rate of the bit. In practice, compromise fluid formulations are used and penetration rate is usually the parameter which has to compromise the most.

The invention aims to provide a method of drilling a borehole which enables a high drilling penetration rate to be achieved without making concessions to the degree of control of the wellbore.

SUMMARY OF THE INVENTION

In accordance with the invention there is provided a method of drilling a borehole using a drill bit coupled to a pipe string comprising a pair of concentric drill pipes with an annular space therebetween. The method comprises drilling a borehole section while circulating a first low-viscosity drilling fluid through the interior of the inner drill pipe, the drill bit and the annular space and keeping a volume of a second fluid substantially stationary in the pipe/formation annulus between the outer pipe string and the borehole wall.

Upon terminating drilling a borehole section, it is preferred to displace said first low-viscosity fluid from the interior of the inner drill pipe string and from said annular space between the pipe strings by circulating said second fluid therethrough until said interior and annular space are completely filled with said second fluid. It is further preferred to use a high-viscosity, high-density mud as said second fluid while e.g. water is used as said first low-viscosity fluid.

BRIEF DESCRIPTION OF THE DRAWINGS

The invention may be carried into practice in various ways but one preferred embodiment will now be explained in detail with reference to the accompanying drawing in which.

DESCRIPTION OF THE PREFERRED EMBODIMENT

Figure 3:
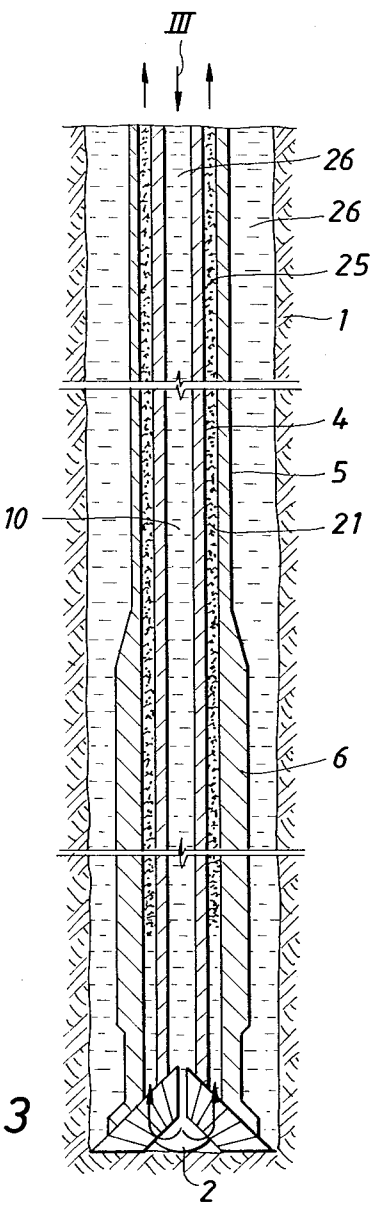
FIG. 3 is a cross-sectional view of a drilling system employing the method of the present invention during displacement of a first fluid from the interior of an inner pipe and from an annular space between concentric drill pipes.
Figure 2:
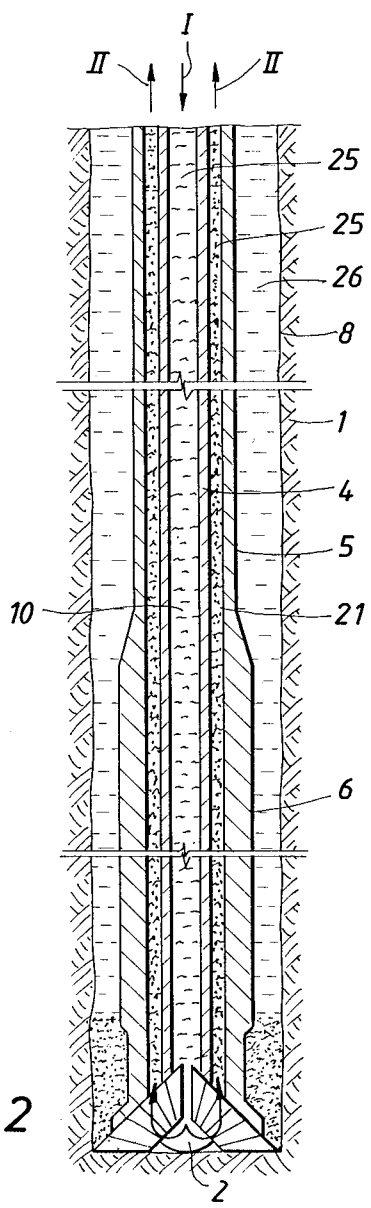
FIG. 2 is a cross-sectional view of a drilling system employing the method of the present invention during drilling of a borehole section.
Figure 1:
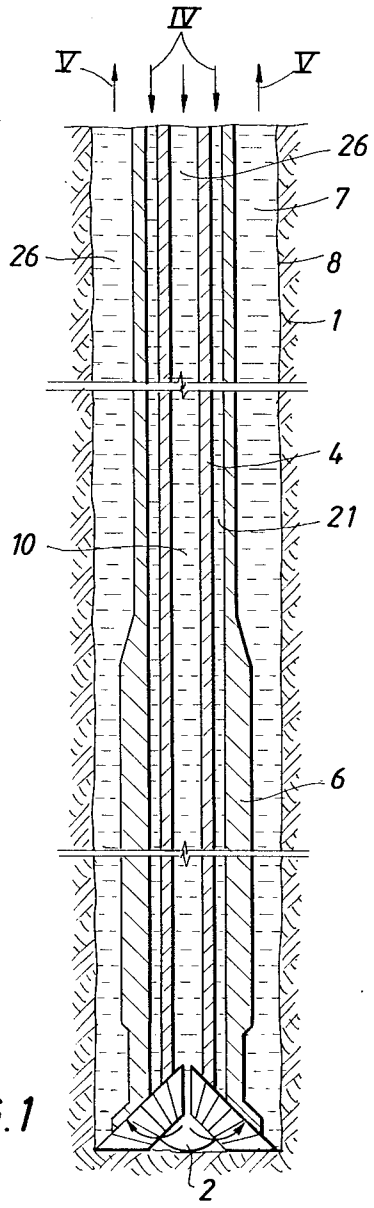
FIG. 1 is a cross-sectional view of a drilling system employing the method of the present invention following displacement of a first fluid from the interior of an inner pipe and from the annular space between concentric drill pipes.

Referring to the FIGS. 1–3 there is shown a borehole penetrating a subsurface earth formation 1. The borehole contains a drilling assembly comprising a rotary drill bit 2 which is coupled to the lower end of a drill string. The drill string consists of a pair of concentric strings of inner and outer drill pipes 4 and 5, respectively.

As illustrated, the lowermost sections 6 of the outer drill pipe 5 have an increased wall thickness, and thus an increased weight, to stabilize the bit 2 during drilling. These sections are further provided with stabilizers (not shown) which centralize the bit 2 in the wellbore.

The stabilizers furthermore restrict flow of fluids from the drill bit 2 into the pipe/formation annulus 7 between the outer pipe string 5 and the borehole wall 8.

As illustrated in FIG. 2, a first low-viscosity fluid 25, such as water, is circulated during drilling down (see arrow I) through the interior 10 of the inner drill pipe and up (see arrow II) through the annular space 21 between the inner and outer pipe. A volume of a second fluid 26, such as a high-density, high-viscosity mud is kept stationary in the pipe/formation annulus 7 during drilling. As can be seen in FIG. 2, the thick sections of the outer drill pipe 5 and the stabilizers mounted thereon form a barrier which separates the first fluid 25 surrounding the bit face from the second fluid 26 filling the annulus 7.

The pipe/formation annulus 7 may be closed at the upper end thereof so that the second fluid 26 is kept substantially stationary during drilling. However, during drilling a small volume of said second fluid may be injected at the upper end of said annulus 7 to compensate for the increased volume of the annulus 7 due to deepening of the borehole and to compensate for the entrainment of the second fluid 26 with the first fluid 25 in the region of the lower sections 6.

If the density of the stationary second fluid 26 is higher than that of the circulating first fluid 25, then the bottom hole circulation pressure of the first fluid 25 should be sufficient to support the weight of the heavier second fluid 26 in the pipe/formation annulus 7. Calculations on bottom hole pressures of circulating drilling fluids have shown that for commercially available concentric drill string assemblies, the bottom hole circulation pressure is generally sufficient to support the weight of the stationary second fluid if a predetermined amount of fluid is circulated. For example, in a 300 m deep borehole, a water circulation rate of 0.16 $m^3$ per minute is generally sufficient to support a mud column having the same density. In a 3000 m deep borehole a water circulation rate of 0.24 $m^3$ per minute is generally sufficient to support a mud column with a density of 1300 $kg/m^3$. These circulation rates are an order of magnitude less than mud drilling fluid circulation rates in boreholes, therefore, supporting of a high-density mud column in the pipe/formation annulus 7 is generally not problematic.

As illustrated in FIG. 3, when drilling is completed or a pipe connection is to be made, the first fluid 25 inside the pipe strings is displaced by injecting the second, heavy and viscosified, fluid 26 into the inner pipe string (see arrow III) until the entire borehole is filled with said second fluid as illustrated in FIG. 1. This ensures that the well is kept under control and that all drill cuttings are removed therefrom. Displacement of the first fluid in the interior of the pipe string will generally take only a few minutes since the second fluid in the annulus is not involved in this process. It may be necessary to refresh the second fluid in the pipe/formation annulus 7 from time to time, for example to keep the so called "mud cake" at the borehole wall in good condition. If replacement is desired, the first fluid in the pipe strings 4 and 5 is first replaced by the second fluid in the manner described with reference to FIG. 3. Then the annulus 7 is opened at the upper end thereof and, as illustrated in FIG. 1, the second fluid is circulated down through both the inner pipe 4 and the annular space between the inner and outer pipe string 4 and 5 (see arrows IV) and displaces the fluid present in the pipe/-formation annulus 7 (see arrows V) by fresh fluid.

Since the second fluid is not circulated during drilling this fluid will hardly be contaminated and, therefore, is likely to be reusable at the end of operations. In recent years it has become practical to add expensive additives to drilling fluids used in a borehole to make the fluid chemically compatible with the formation surrounding the hole and to provide a uniform plastering of the wellbore. Reusability of such fluids provides a significant reduction of drilling costs.

The first fluid which is circulated during drilling through the drill string is usually a comparatively cheap, low-density, low-viscosity fluid, such as water, oil or brine, which can be circulated at high speed through the drill string so that optimum cooling of the drill bit can be achieved and drill cuttings are quickly removed from the borehole. In most formations a high-viscosity, high-density drilling mud will be used as said second annular fluid.

In some formations, for example in formations with a high permeability where lost circulation problems are likely to occur, the density of the second fluid may be selected equal or even lower than that of the first, circulating fluid.

It will be understood that in accordance with the present invention various types of fluids may be circulated through the drill string as said first fluid and that various types of fluids may be injected into the pipe/formation annulus as said second fluid, but that it is essential that during drilling a dual-fluid system is present in the borehole and that the second fluid is kept stationary in the pipe/formation annulus and is not circulated via the drill string and drill bit as is the first fluid.

It will be further understood that other flow restrictors may be mounted at the lower end of the annulus, such as a sealing skirt which opens if the circulation pressure exceeds a pre-set value in addition to, or instead of, the flow restriction provided by stabilizers and/or drill string sections with increased wall thickness. Finally, it will be understood that the drilling assembly may be provided with additional downhole equipment such as a downhole drilling motor and monitoring instruments which may be combined with mud pulse telemetering devices.

Many other variations and modifications may be made in the apparatus and techniques described above by those having experience in the technology without departing from the concept of the present invention. Accordingly, it should be clearly understood that the apparatus and methods depicted in the accompanying drawings and referred to in the foregoing description are illustrative only and are not intended as limitations on the scope of the invention.

What is claimed is:

1. A method of drilling a borehole using a drill bit coupled to a pipe string comprising a pair of concentric drill pipes with an annular space therebetween, the method comprising:

drilling a borehole section;

circulating a first low-viscosity drilling fluid through the interior of the inner drill pipe, the drill bit and the annular space between the pipes;

keeping a volume of a second fluid having properties dissimilar to the first low viscosity drilling fluid substantially stationary in a pipe/formation annulus between the outer pipe string and the borehole wall; and displacing said first low-viscosity drilling fluid from the interior of the inner pipe and from the annular space between the pipes upon cessation of drilling the bore hold section by circulating said second fluid therethrough until said interior and annular space are completely filled with said second fluid.

2. The method of claim 1, wherein upon filling said interior and annular space with said second fluid, the second fluid is circulated down through the pipe string and up through the pipe/formation annulus.

3. The method of claim 1, wherein during drilling a selected amount of said second fluid is added on top of the substantially stationary volume of said second fluid in the pipe/formation annulus.

4. The method of claim 1, wherein said first low-viscosity drilling fluid is water.

5. The method of claim 1, wherein said second fluid is a weighted mud.

6. The method of claim 1, wherein during drilling the first low-viscosity drilling fluid is circulated down through the interior of the inner drill pipe and up through said annular space.

7. The method of claim 1, wherein flow restrictor means are mounted on the outer drill pipe for restricting flow of fluid from the bottom of the borehole into said annulus and vice versa.

8. A method of drilling a borehole, comprising:

drilling a borehole section by driving a drill bit coupled to a pipe string having a pair of concentric drill pipes with an annular space therebetween;

circulating a first low-viscosity drilling fluid through the interior of the inner drill pipe, the drill bit and the annular space between the pipes while drilling the borehole section;

keeping a volume of a second fluid, having properties dissimilar to the first low viscosity drilling fluid, substantially stationary in a pipe/formation annulus between the outer pipe string and the borehole wall while drilling the borehole section;

displacing said first fluid from the interior of the inner pipe and from the annular space between the pipes following drilling the borehole section by circulating said second fluid therethrough until said interior and annular space are completely filled with said second fluid.

9. The method of claim 8, further comprising the step of circulating the second fluid down through the pipe string and up through the pipe/formation annulus following the step of displacing the first fluid.

10. The method of claim 9, further comprising adding a selected amount of said second fluid on top of the substantially stationary volume of said second fluid in the pipe/formation annulus while drilling the borehole section.

11. The method of claim 8, wherein said first low-viscosity drilling fluid is water.

12. The method of claim 8, wherein said second fluid is a weighted mud.

13. The method of claim 8, wherein circulating a first low-viscosity drilling fluid comprises circulating the first low-viscosity drilling fluid down through the interior of the inner drill pipe and up through said annular space.

14. The method of claim 8, further comprising restricting flow of fluid from the bottom of the borehole into said annulus and vice versa by mounting flow restrictor means on the outer drill pipe.

* * * * *